US012075834B2

(12) United States Patent
Lee

(10) Patent No.: US 12,075,834 B2
(45) Date of Patent: Sep. 3, 2024

(54) CARTRIDGE WITH ATOMIZER, LIQUID STORAGE, AND MOUTHPIECE AND AEROSOL GENERATING DEVICE INCLUDING THE SAME

(71) Applicant: KT&G CORPORATION, Daejeon (KR)

(72) Inventor: Jong Sub Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 624 days.

(21) Appl. No.: 17/293,111

(22) PCT Filed: Jul. 28, 2020

(86) PCT No.: PCT/KR2020/009928
§ 371 (c)(1),
(2) Date: May 12, 2021

(87) PCT Pub. No.: WO2021/020861
PCT Pub. Date: Feb. 4, 2021

(65) Prior Publication Data

US 2022/0007727 A1 Jan. 13, 2022

(30) Foreign Application Priority Data

Jul. 31, 2019 (KR) ..... 10-2019-0093372
Oct. 11, 2019 (KR) ..... 10-2019-0126289

(51) Int. Cl.
*A24F 40/48* (2020.01)
*A24F 40/42* (2020.01)
(Continued)

(52) U.S. Cl.
CPC ..... *A24F 40/48* (2020.01); *A24F 40/42* (2020.01); *A24F 40/44* (2020.01); *A24F 40/485* (2020.01);
(Continued)

(58) Field of Classification Search
CPC ..... A24F 40/48; A24F 40/42; A24F 40/44; A24F 40/485; A24F 40/10; A24F 40/40; A24D 3/00; A24D 3/17
See application file for complete search history.

(56) References Cited

U.S. PATENT DOCUMENTS 10,004,272 B2 6/2018 Li et al.
10,661,032 B2 5/2020 Li et al.
(Continued)

FOREIGN PATENT DOCUMENTS

CN 204157645 U * 2/2015
CN 204157645 U 2/2015
(Continued)

OTHER PUBLICATIONS

Chinese Office Action dated May 10, 2023 in CN 202080008037.2.
(Continued)

*Primary Examiner* — Justin M Kratt
(74) *Attorney, Agent, or Firm* — Sughrue Mion, PLLC

(57) ABSTRACT

A cartridge includes: a liquid storage that accommodates an aerosol generating material; an atomizer receives the aerosol generating material from the liquid storage and generates an aerosol from the aerosol generating material; a mouthpiece which is coupled to an end of the liquid storage and includes a discharge hole through which the aerosol generated from the aerosol generating material is discharged; a delivery tube arranged inside the liquid storage and connecting the discharge hole of the mouthpiece and the atomizer such that the aerosol generated in the atomizer is delivered to the discharge hole; and an absorbent element that is arranged on a delivery path of the aerosol between the delivery tube and the discharge hole, and absorbs a liquid.

10 Claims, 11 Drawing Sheets

(51) Int. Cl.

| | |
|---|---|
| ***A24F 40/44*** | (2020.01) |
| ***A24F 40/485*** | (2020.01) |
| *A24D 3/00* | (2020.01) |
| *A24D 3/17* | (2020.01) |
| *A24F 40/10* | (2020.01) |
| *A24F 40/40* | (2020.01) |

(52) U.S. Cl.
CPC ..... *A24D 3/00* (2013.01); *A24D 3/17* (2020.01); *A24F 40/10* (2020.01); *A24F 40/40* (2020.01)

(56) References Cited

U.S. PATENT DOCUMENTS

| | | | | |
|---|---|---|---|---|
| 2014/0261500 | A1 | 9/2014 | Park | |
| 2015/0007836 | A1 | 1/2015 | Li et al. | |
| 2015/0272216 | A1 | 10/2015 | Dai et al. | |
| 2016/0227837 | A1* | 8/2016 | Hammel | A24D 3/17 |
| 2017/0281883 | A1 | 10/2017 | Li et al. | |
| 2018/0279682 | A1 | 10/2018 | Guo et al. | |
| 2019/0208821 | A1 | 7/2019 | Fraser et al. | |

FOREIGN PATENT DOCUMENTS

| | | | | |
|---|---|---|---|---|
| CN | 205456063 | U | 8/2016 | |
| CN | 206808661 | U * | 12/2017 | A24F 47/006 |
| CN | 206808661 | U | 12/2017 | |
| EP | 3 158 883 | A2 | 4/2017 | |
| EP | 3158883 | A2 * | 4/2017 | A24F 40/485 |
| KR | 10-2012-0016167 | A | 2/2012 | |
| KR | 10-2014-0067691 | A | 6/2014 | |
| KR | 10-2017-0049699 | A | 5/2017 | |
| KR | 20-0483852 | Y1 | 7/2017 | |
| KR | 10-2019-0034141 | A | 4/2019 | |
| WO | 2016/036236 | A2 | 3/2016 | |
| WO | 2016/126544 | A1 | 8/2016 | |
| WO | 2018/214065 | A1 | 11/2018 | |

OTHER PUBLICATIONS

Office Action issued Aug. 30, 2022 in Japanese Application No. 2021-539399.

Korea Intellectual Property Office Notification of Reason for Refusal for KR 10-2019-0126289 dated Apr. 22, 2021.

International Search Report for PCT/KR2020/009928 dated Dec. 2, 2020 [PCT/ISA/210].

Written Opinion for PCT/KR2020/009928 dated Dec. 2, 2020 [PCT/ISA/237].

Notification of Reason for Refusal dated Oct. 20, 2021 from the Korean Patent Office in Korean Application No. 10-2019-0126289.

Extended European Search Report dated Nov. 22, 2021 in European Application No. 20846045.1.

* cited by examiner

CARTRIDGE WITH ATOMIZER, LIQUID STORAGE, AND MOUTHPIECE AND AEROSOL GENERATING DEVICE INCLUDING THE SAME

CROSS REFERENCE TO RELATED APPLICATIONS

This application is a National Stage of International Application No. PCT/KR2020/009928 filed Jul. 28, 2020, claiming priority based on Korean Patent Application No. 10-2019-0093372 filed Jul. 31, 2019 and Korean Patent Application No. 10-2019-0126289 filed Oct. 11, 2019.

TECHNICAL FIELD

One or more embodiments relate to a cartridge capable of generating a high-quality aerosol and an aerosol generating device including the same, and more particularly, to a cartridge capable of improving an inhalation sensation of an aerosol and an aerosol generating device including the same.

BACKGROUND ART

Recently, the demand for alternatives to traditional combustive cigarettes has increased. For example, there is growing demand for devices that generates aerosol by heating an aerosol generating material in cigarettes or liquid storages, rather than by combusting cigarettes.

Among non-combustive type aerosol generating devices, some aerosol generating devices include cartridges that accommodate aerosol generating materials.

DISCLOSURE OF INVENTION

Solution to Problem

One or more embodiments include a cartridge capable of generating a high-quality aerosol and an aerosol generating device including the same.

One or more embodiments include a cartridge capable of improving an inhalation sensation of an aerosol and an aerosol generating device including the same.

According to one or more embodiments, a cartridge includes: a liquid storage configured to accommodate an aerosol generating material; an atomizer configured to receive the aerosol generating material from the liquid storage and generate an aerosol from the aerosol generating material; a mouthpiece coupled to an end of the liquid storage and including a discharge hole through which the aerosol is discharged; a delivery tube arranged inside the liquid storage and connecting the discharge hole of the mouthpiece and the atomizer such that the aerosol generated in the atomizer is delivered to the discharge hole; and an absorbent element arranged on a delivery path of the aerosol between the delivery tube and the discharge hole, and configured to absorb a liquid.

The problems to be solved through one or embodiments are not limited to the problems described above, and unmentioned problems will be clearly understood by one of ordinary skill in the art from the present specification and the accompanying drawings.

Advantageous Effects of Invention

A liquid idinary skill in then an aerosol generating device may arrive directly into an oral cavity of a user and give the user an unpleasant feeling. Such an unpleasant feeling of the user may be prevented by a cartridge and an aerosol generating device according to one or more embodiments.

The effects according to one or more embodiments are not limited to the effects described above, and unmentioned effects will be clearly understood by one of or art from the present specification and the accompanying drawings.

BEST MODE FOR CARRYING OUT THE INVENTION

Figure 1:
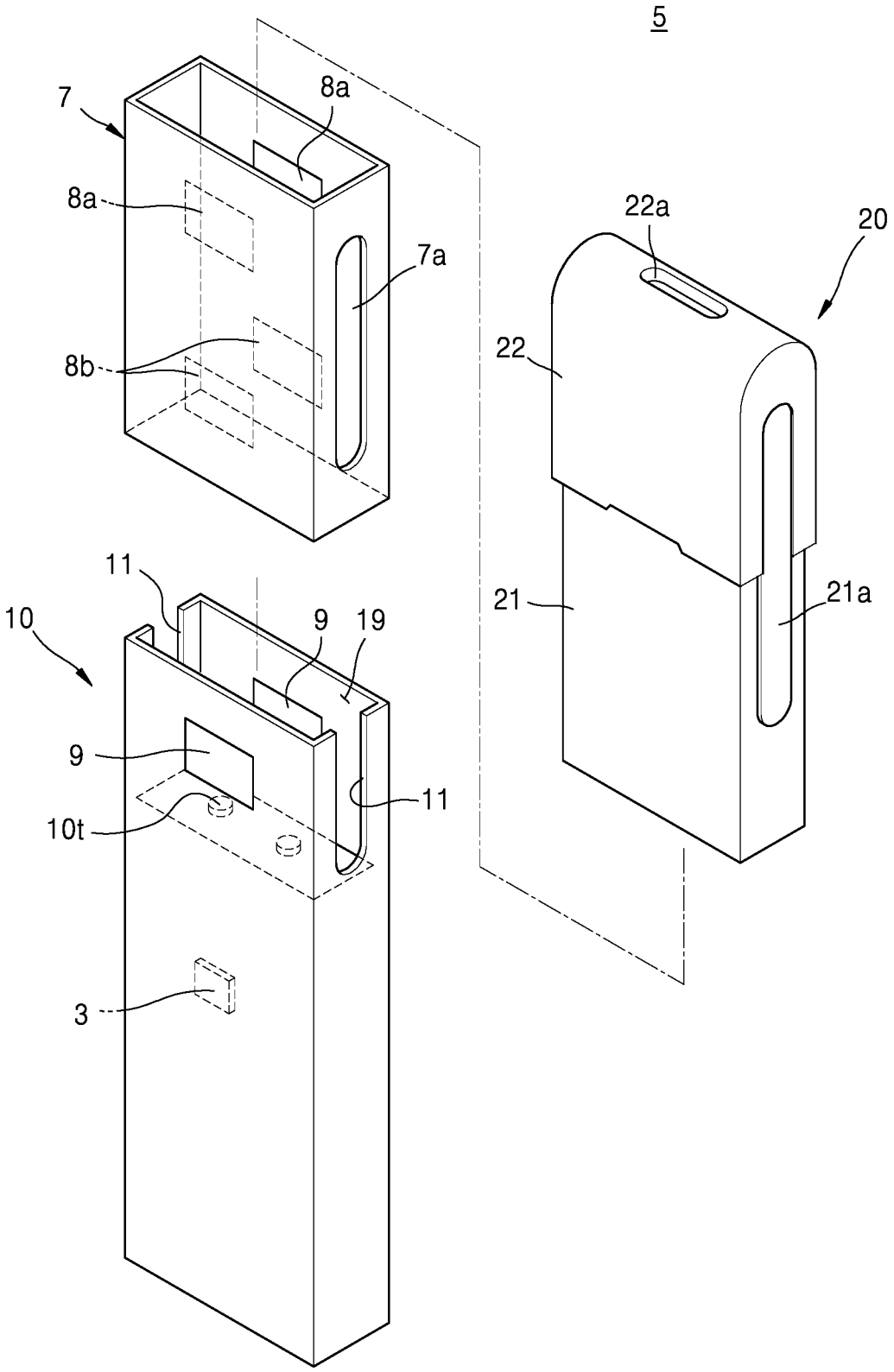
FIG. 1 is an exploded perspective view schematically illustrating a coupling relationship between a replaceable cartridge containing an aerosol generating material and an aerosol generating device including the same, according to an embodiment.

According to one or more embodiments, a cartridge includes: a liquid storage configured to accommodate an aerosol generating material; an atomizer configured to receive the aerosol generating material from the liquid storage and generate an aerosol from the aerosol generating material; a mouthpiece coupled to an end of the liquid storage and including a discharge hole through which the aerosol is discharged; a delivery tube arranged inside the liquid storage and connecting the discharge hole of the mouthpiece and the atomizer such that the aerosol generated in the atomizer is delivered to the discharge hole; and an absorbent element arranged on a delivery path of the aerosol between the delivery tube and the discharge hole, and configured to absorb a liquid.

The cartridge may further include a placement portion on which the absorbent element is disposed.

When the absorbent element may be fixed by coupling the mouthpiece to the liquid storage.

The absorbent element may be located in the discharge hole, and the cartridge further includes a fixing element configured to fix the absorbent element in the discharge hole.

A cross section of the cartridge may include two long sides facing each other and extending along a surface, and two short sides having lengths shorter than the long sides and respectively connecting both ends of the two long sides.

A cross-sectional shape of the absorbent element may correspond to a cross-sectional shape of the cartridge, and the absorbent element may include a through-hole through which the aerosol passes.

The absorbent element may include two absorbent element parts spaced apart from each other such that the delivery path is positioned between the two absorbent element parts.

The absorbent element may include at least one another absorbent element arranged to connect the two absorbent element parts.

A volume of the absorbent element may be between about 50 $mm^3$ and about 120 $mm^3$.

The cartridge may further include a net arranged on the delivery path along which the aerosol is delivered and preventing movement of the liquid.

The absorbent element may include at least one of sponge, felt, and cotton.

The atomizer may include: a heater configured to heat the aerosol generating material; a lower cap that surrounds the heater and encloses another end of the liquid storage, thereby forming a chamber in which the aerosol is generated; and a liquid delivery element arranged in the chamber of the lower cap and configured to absorb the aerosol generating material and generate the aerosol when heated by the heater, wherein an end of the delivery tube communicates with the chamber.

According to one or more embodiments, an aerosol generating device includes: a cartridge; a main body including an accommodation space that allows the cartridge to be detachably coupled to the main body; and a slider movably coupled to the main body such that at least a portion of the mouthpiece is covered and exposed according to movement of the slider.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure can, however, be embodied in many different forms and should not be construed as being limited to the embodiments set forth herein.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 may be inserted into an accommodation space 19 of the main body 10 so that the cartridge 20 may be coupled to the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material, using, for example, an ultrasonic vibration method or an induction heating method. In an embodiment, the cartridge 20 may include its own power source and generate aerosol based on an electric control signal or a wireless signal received from the main body 10.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element containing an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

At least a portion of the liquid storage 21 of the cartridge 20 may include a transparent portion so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 in such a way that the slider 7 may move along the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* may be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

Depending on the position of the slider 7, an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and may generate a signal based on the detected change.

In the aerosol generating device 5 according to the embodiment described above, a horizontal cross section (i.e., a cross section viewed in the longitudinal direction) of the main body 5, the cartridge 20, and the slider 7 is an approximately rectangular shape. In other words, the cross section may include two long sides facing each other and extending along a surface, and two short sides having lengths shorter than the two long sides and respectively connecting both ends of the two long sides. However, embodiments are not limited thereto. The aerosol generating device 5 may have, for example, a cross-sectional shape of a circle, an ellipse, a square, or various polygonal shapes.

In addition, the aerosol generating device 5 is not necessarily limited to a structure that extends linearly in the longitudinal direction. For example, the aerosol generating device 5 may be curved in a streamlined shape or bent at a preset angle in a specific area to be easily held by the user.

Figure 2:
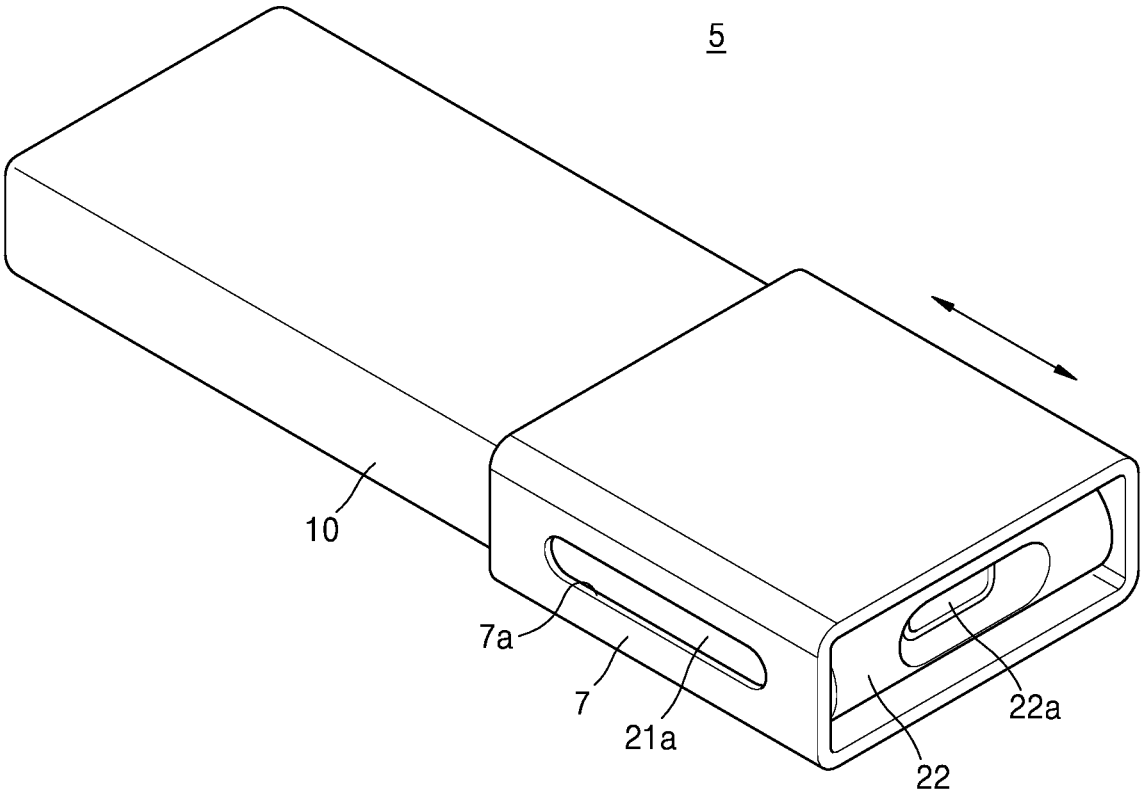
FIG. 2 is a perspective view of an exemplary operating state of the aerosol generating device according to the embodiment illustrated in FIG. 1.

FIG. 2 is a perspective view of an exemplary operating state of the aerosol generating device according to the embodiment illustrated in FIG. 1.

In FIG. 2, the slider 7 is moved to a position where the end of the mouthpiece 22 of the cartridge coupled to the main body 10 is covered. In this state, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

Figure 3:
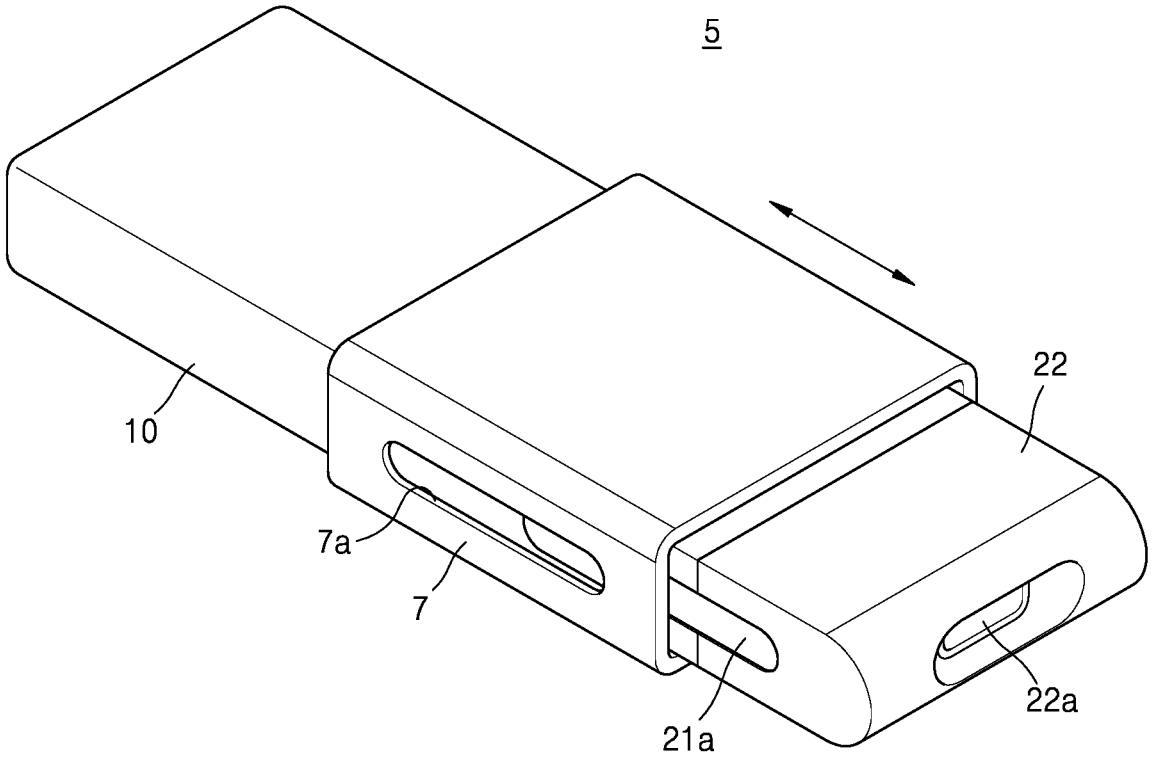
FIG. 3 is a perspective view of another exemplary operating state of the aerosol generating device according to the embodiment illustrated in FIG. 1.

FIG. 3 is a perspective view of another exemplary operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge is still exposed to the outside through the elongated hole 7*a* of the slider 7 when the slider 7 is moved to the position where the end of the mouthpiece 22 is exposed to the outside. Thus, the user may visually check the remaining amount of aerosol generating material contained in the cartridge, regardless of the position of the slider 7.

Referring to FIG. 1, the aerosol generating device 5 may include the position change detecting sensor 3. The position change detecting sensor 3 may detect a change in a position of the slider 7.

In an embodiment, the position change detecting sensor 3 may detect a change in an orientation, intensity or the like of magnetization or a magnetic field of a magnetic material. The slider 7 may include a magnet, and the position change detecting sensor 3 may detect a movement of the magnet included in the slider 7.

For example, the position change detecting sensor 3 may include a Hall effect sensor, a rotating coil, a magnetoresistor, or a superconducting quantum interference device (SQUID). However, embodiments of the present disclosure are not limited thereto.

Hereinafter, a position of the slider 7 covering an end of the mouthpiece 22 as illustrated in FIG. 2 will be referred to as a first position, and a position of the slider 7 exposing the end of the mouthpiece 22 to the outside as illustrated in FIG. 3 will be referred to as a second position. While the slider 7 is coupled to the main body 10, the user may move the slider 7 between the first position and the second position. The position change detecting sensor 3 may detect a change in the position of the slider 7 moving between the first position and the second position.

In an embodiment, when the slider 7 moves from the first position to the second position, a controller of the aerosol generating device 5 may receive an input signal from the position change detecting sensor 3. In response to the input signal, the controller may set a mode of the aerosol generating device 5 to a preheating mode.

Also, the controller may determine whether or not the cartridge 20 is coupled to the main body 10. The aerosol generating device 5 may include an additional sensor for detecting whether or not the cartridge 20 is coupled to the main body 10. Alternatively, the controller may periodically apply a current to an internal circuit of the main body 10 electrically connected to the heater of the cartridge 20 and receive an output value therefrom to thereby determine whether or not the cartridge 20 is mounted in the main body 10.

In an embodiment, after the cartridge 20 is mounted in the main body 10, the controller may set the mode of the aerosol generating device 5 to the preheating mode, in response to the input signal received from the position change detecting sensor 3. When the cartridge 20 is determined as being not mounted in the main body 10, although the controller receives the input signal from the position change detecting sensor 3, the controller may not set the mode of the aerosol generating device 5 to the preheating mode.

Also, the controller may change the mode of the aerosol generating device 5 to a sleep mode, on the basis of a change in the position of the slider 7. In an embodiment, when the slider 7 moves from the second position to the first position, the controller may set the mode of the aerosol generating device 5 to the sleep mode after receiving the input signal from the position change detecting sensor 3.

Figure 4:
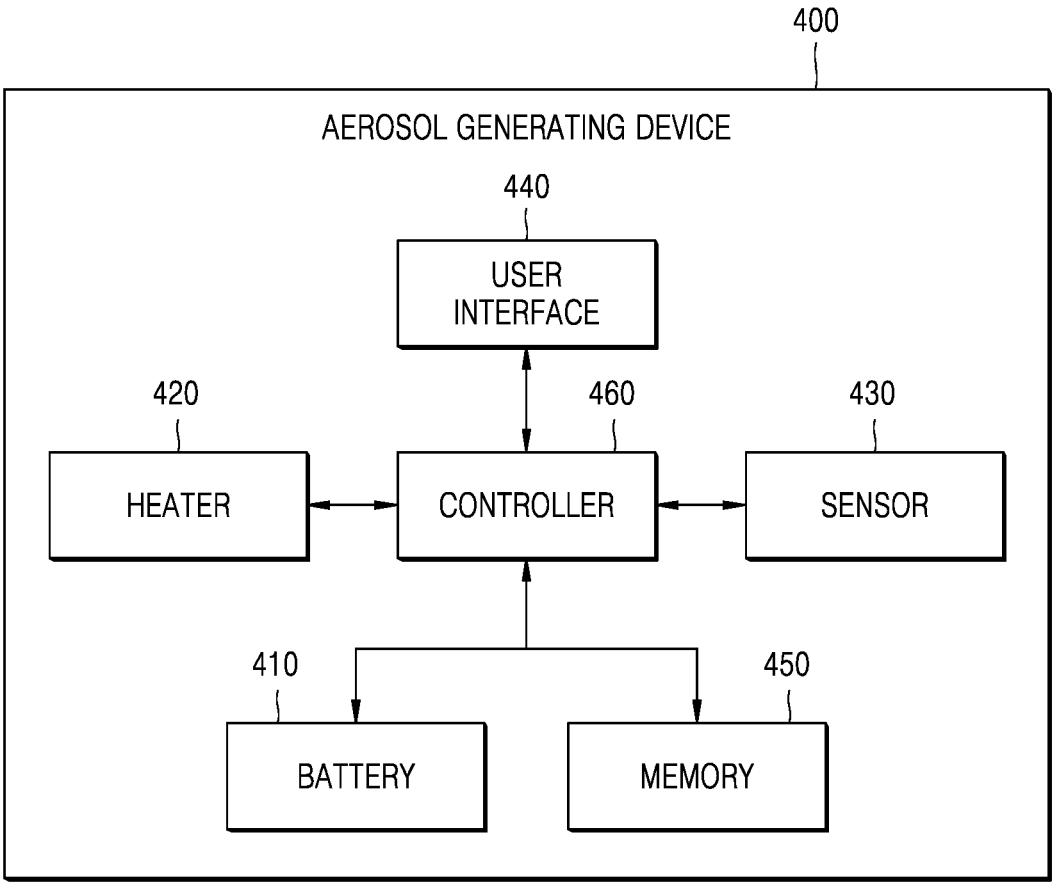
FIG. 4 is a block diagram illustrating hardware components of the aerosol generating device according to an embodiment.

FIG. 4 is a block diagram illustrating hardware components of the aerosol generating device according to an embodiment.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may only include a main body without a cartridge. In this case, the components of the aerosol generating device 400 may be located in the main body. In another embodiment, the aerosol generating device 400 may include a main body and a cartridge, in which case the components of the aerosol generating device 400 may be distributed between the main body and the cartridge. Also, at least some of the components of the aerosol generating device 400 may be located in both the main body and the cartridge.

Hereinafter, an operation of each of the components will be described without limiting the location of each component.

The battery 410 supplies electric power to be used for the aerosol generating device 400 to operate. In other words, the battery 410 may supply power such that the heater 420 may be heated. In addition, the battery 410 may supply power required for operation of other hardware components included in the aerosol generating device 400, such as the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat a cigarette inserted into the aerosol generating device 400, or heat the cartridge coupled to the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and/or the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be absorbed and transferred by the liquid delivery element, and the heater 420 may heat the aerosol generating material absorbed by the liquid delivery element, thereby generating aerosol. For example, the heater 420 may include a material such as nickel or chromium and may be wound around or arranged adjacent to the liquid delivery element.

In another embodiment, the heater 420 may heat the cigarette inserted into the accommodation space of the aerosol generating device 400. As the cigarette is accommodated in the accommodation space of the aerosol generating device 400, the heater 420 may be located inside and/or outside the cigarette. Accordingly, the heater 420 may generate aerosol by heating the aerosol generating material in the cigarette.

Meanwhile, the heater 420 may include an induction heater. The heater 420 may include an electrically conductive coil for heating a cigarette or the cartridge by an induction heating method, and the cigarette or the cartridge may include a susceptor which may be heated by the induction heater.

The aerosol generating device 400 may include at least one sensor 430. A sensing result from the at least one sensor 430 is transmitted to the controller 460, and the controller 460 may control the aerosol generating device 400 to perform various functions such as controlling the operation of the heater, restricting smoking, determining whether a cigarette (or a cartridge) is inserted, and displaying a notification, according to the sensing result.

For example, the at least one sensor 430 may include a puff detecting sensor. The puff detecting sensor may detect a user's puff based on any one of a temperature change, a flow change, a voltage change, and/or a pressure change.

In addition, the at least one sensor 430 may include a temperature sensor. The temperature sensor may detect a temperature at which the heater 420 (or an aerosol generating material) is heated. The aerosol generating device 400 may include a separate temperature sensor for sensing a temperature of the heater 420, or the heater 420 itself may serve as a temperature sensor instead of including a separate temperature sensor. Alternatively, a separate temperature sensor may be further included in the aerosol generating device 400 while the heater 420 also serves as a temperature sensor.

In addition, the at least one sensor 430 may include a position change detecting sensor. The position change detecting sensor may detect a change in a position of the slider that is movably coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices.

However, the aerosol generating device 400 may be implemented by selecting only some of the above-described various interfacing devices.

The memory 450 may store data processed or to be processed by the controller 460. The memory 450 may include various types of memories, such as random access memory, such as dynamic random access memory (DRAM), static random access memory (SRAM), etc., read-only memory (ROM), electrically erasable programmable read-only memory (EEPROM), etc.

The memory 450 may store data about an operation time of the aerosol generating device 400, the maximum number of puffs, the current number of puffs, at least one temperature profile, at least one power profile, and a smoking pattern of the user, and the like.

The controller 460 may control overall operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 4600 analyzes a sensing result of the sensing by at least one sensor 430, and controls subsequent processes that are to be performed subsequently.

The controller 460 may control power supplied to the heater 420 so that the operation of the heater 420 is started or terminated, based on the sensing result of the at least one sensor 430. In addition, based on the sensing result from the at least one sensor 430, the controller 460 may control the amount of power supplied to the heater 420 and the time at which the power is supplied, so that the heater 420 is heated to a predetermined temperature or maintained at an appropriate temperature.

In an embodiment, the aerosol generating device 400 may have a plurality of modes. For example, a mode of the aerosol generating device 400 may include a preheating mode, an operation mode, an idle mode, and a sleep mode. However, the mode of the aerosol generating device 400 is not limited thereto.

When the aerosol generating device 400 is not used, the aerosol generating device 400 may maintain the sleep mode, and the controller 460 may control output power of the battery 410 such that power is not supplied to the heater 420 in the sleep mode. For example, before the aerosol generating device 400 is used or after use of the aerosol generating device 400 is ended, the aerosol generating device 400 may operate in the sleep mode.

The controller 460 may set the mode of the aerosol generating device 400 to the preheating mode (e.g., change the mode of the aerosol generating device 400 from the sleep mode to the preheating mode) to start an operation of the heater 420 after receiving a user input for the aerosol generating device 400.

Also, the controller 460 may detect a puff of the user by using the puff detecting sensor and then change the mode of the aerosol generating device 400 from the preheating mode to a heating mode.

In addition, when the aerosol generating device 400 operates in the heating mode for longer than a preset time, the controller 460 may change the mode of the aerosol generating device 400 from the heating mode to the idle mode.

Moreover, the controller 460 may count the number of puffs by using the puff detecting sensor. If the number of puffs reaches a predetermined maximum number of puffs, the controller 460 may stop supplying power to the heater 420.

Temperature profiles respectively corresponding to the preheating mode, the operation mode, and the idle mode may be set. The controller 460 may control power supplied to the heater 420 on the basis of a power profile for each mode such that an aerosol generating material is heated according to a temperature profile for each mode.

The controller 460 may control the user interface 440 based on a sensing result from at least one sensor 430. For example, the controller 460 may count the number of puffs by using the puff detecting sensor. When the current number of puffs reaches a preset number, the controller 460 may notify the user that the aerosol generating device 400 is to shut down soon, by using at least one of a lamp, a motor, and a speaker.

In an embodiment, the preset number of puffs may be the number that is acquired by subtracting a certain number (e.g., one) from the predetermined maximum number of puffs. For example, when the maximum number of puffs is set to ten, the controller 460 may count the number of puffs by using the puff detecting sensor. When the current number of puffs reaches nine times, assuming that the certain number is set to one, the controller 460 may notify the user that the aerosol generating device 400 is to shut down shortly, by using at least one of the lamp, the motor, and the speaker.

Also, the controller 460 may count the number of puffs by using the puff detecting sensor. When the current number of puffs reaches the maximum number of puffs, the controller 460 may end the operation of the heater 420. For example, when the current number of puffs reaches the maximum number of puffs, the controller 460 may set the mode of the aerosol generating device 400 to the sleep mode.

Although not illustrated in FIG. 4, an aerosol generating system may be configured by the aerosol generating device 400 and a separate cradle. For example, the cradle may be used to charge the battery 410 of the aerosol generating device 400. For example, the aerosol generating device 400 may be supplied with power from a battery of the cradle to charge the battery 410 of the aerosol generating device 400 while being accommodated in an accommodation space of the cradle.

Figure 5:
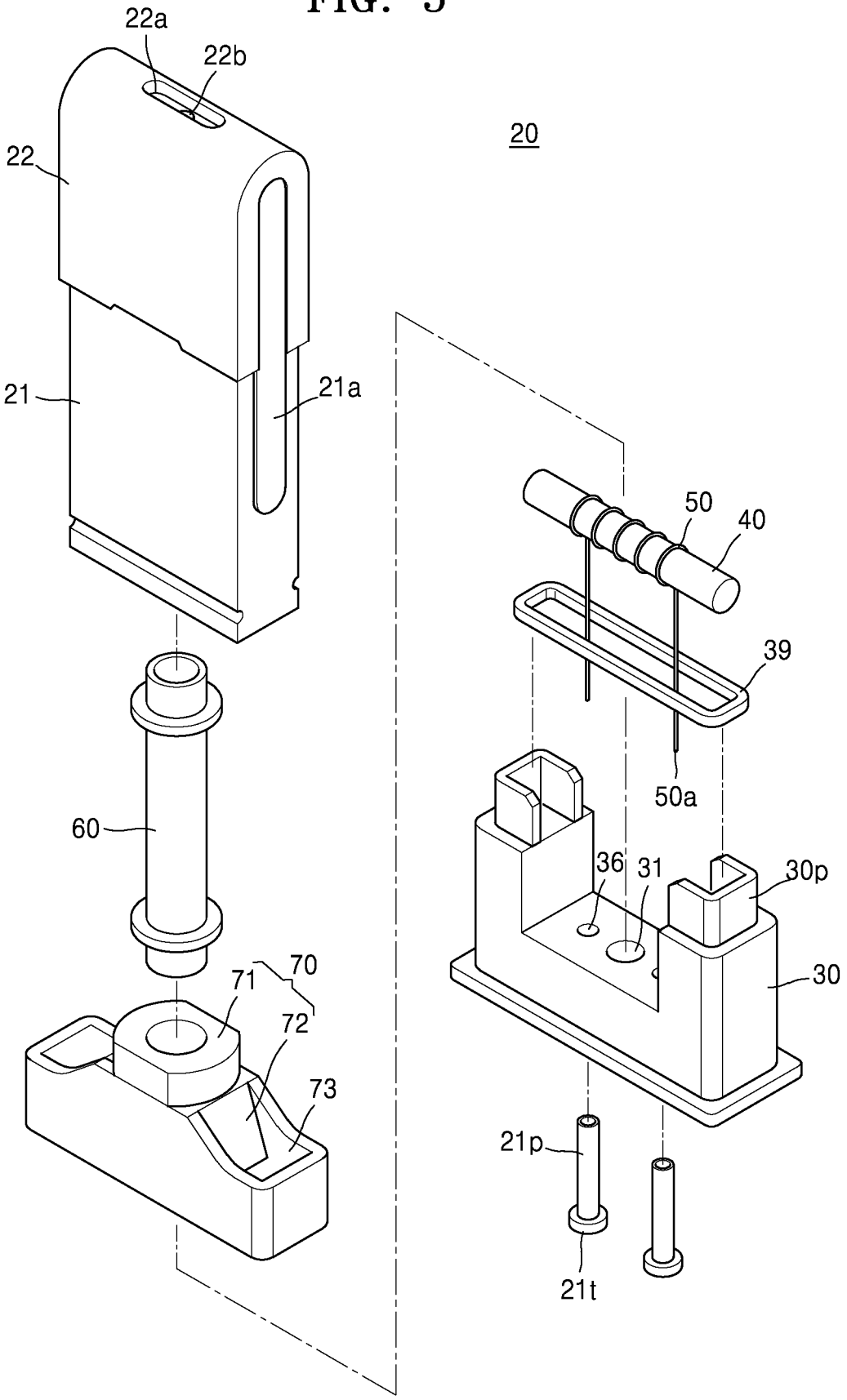
FIG. 5 is an exploded perspective view schematically illustrating a cartridge according to an embodiment.
Figure 6:
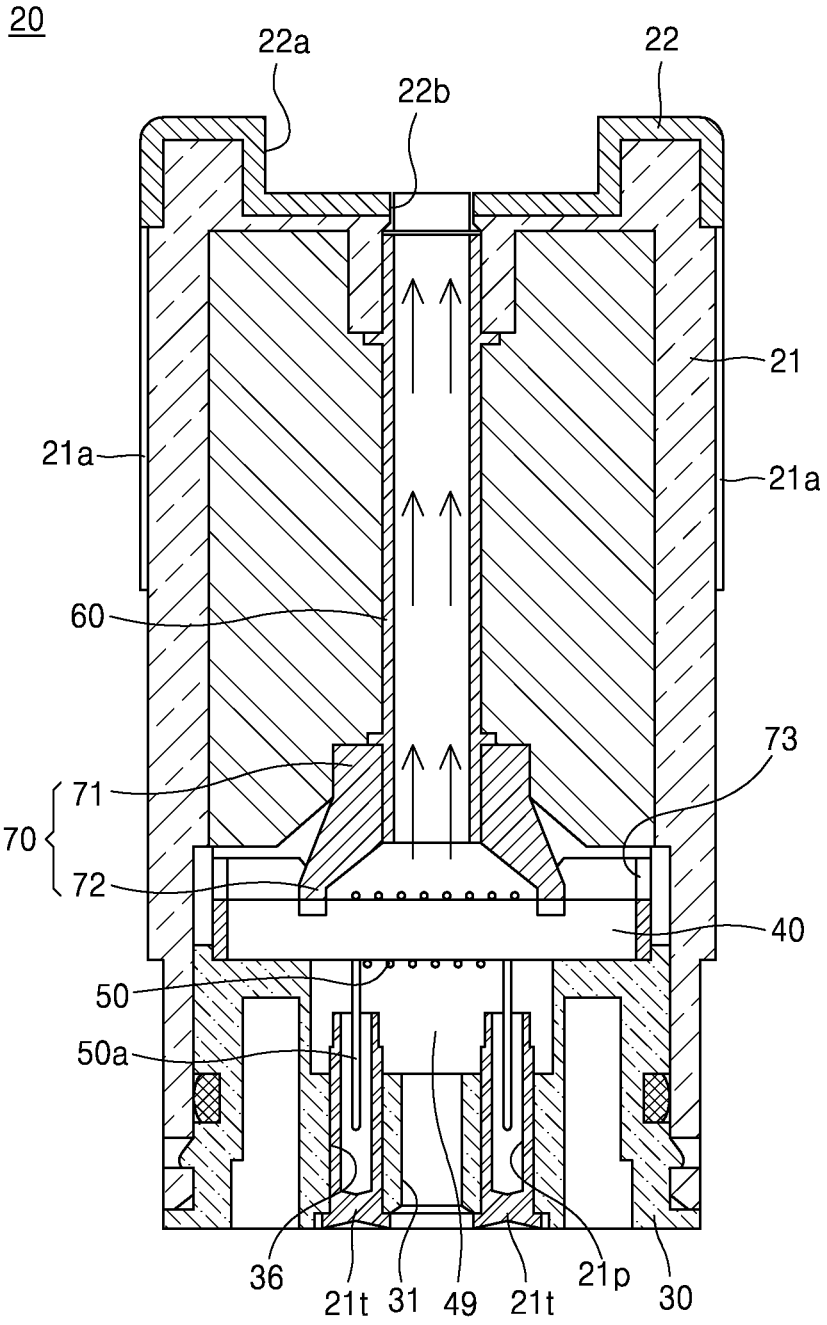
FIG. 6 is a cross-sectional view of the cartridge illustrated in FIG. 5.

FIG. 5 is an exploded perspective view schematically illustrating a cartridge according to an embodiment. FIG. 6 is a cross-sectional view of the cartridge illustrated in FIG. 5.

Referring to FIGS. 5 and 6, as described above, a cartridge 20 may include a liquid storage 21 and an atomizer.

The atomizer includes a heater 50 that is arranged in the liquid storage 21 and generates an aerosol by heating an aerosol generating material, a lower cap 30 that surrounds the heater 50 and forms a chamber 49 in which the aerosol may be generated, and a liquid delivery element 40 that is arranged in the chamber 49 of the lower cap 30 to be heated by the heater 50 and absorbs the aerosol generating material. The liquid delivery element 40 may continuously keep absorbing the aerosol generating material. When the liquid delivery element 40 is heated by the heater 50, the aerosol generating material kept in the liquid delivery element 40 is vaporized to generate the aerosol.

Structures of the heater 50, the lower cap 30, and the liquid delivery element 40 that are illustrated in FIGS. 5 and 6 are an example and may be modified into various shapes. For example, the heater 50 may be arranged adjacent to the liquid delivery element 40 without being wound around the liquid delivery element 40. Also, the structure of the liquid delivery element 40 may be modified into a mesh shape or a plate shape. In an embodiment, the heater 50 and the liquid delivery element 50 may be integrated into a single body (e.g., a mesh-shaped heater formed of a metal material).

A mouthpiece 22 is coupled to an end of the liquid storage 21, and the lower cap 30 is coupled to the other end of the liquid storage 21. The lower cap 30 may support the liquid delivery element 40 and the heater 50, and also seal the other end of the liquid storage 21. The lower cap 30 may have support protrusions 30*p* at an upper end for supporting both ends of the liquid delivery element 40.

The lower cap 30 may be inserted into the other end of the liquid storage 21. Also, for effective sealing, a sealing ring 39 made of an elastic material, such as rubber or silicon, may be arranged between the lower cap 30 and the liquid storage 21.

Also, the lower cap 30 may include an air passage 31 through which air is delivered to the chamber 49. External air may be supplied to the liquid delivery element 40 by passing through the air passage 31 of the lower cap 30.

The liquid storage 21 may include a delivery tube 60 for connecting a discharge hole 22*a* of the mouthpiece 22 to the chamber 49 in which the aerosol is generated. Thereby, the aerosol generated in the chamber 49 may be delivered to the discharge hole 22*a*. For example, an end of the delivery tube 60 may be connected to the chamber 49, and the other end of the delivery tube 60 may be connected to the discharge hole 22*a* of the mouthpiece 22. Referring to FIG. 6, the arrows indicate a path along which the aerosol generated in the chamber 49 moves. The aerosol may be delivered to the discharge hole 22*a* through the delivery tube 60. According to the embodiment illustrated in FIGS. 5 and 6, the delivery tube 60 is arranged on a central axis line of the liquid storage 21 along a longitudinal direction in which the liquid storage 21 extends. However, the embodiment is not limited thereto. For example, the delivery tube 60 may be arranged to be inclined toward an edge of the liquid storage 21.

A pressurizer 70 is arranged between the delivery tube 60 and the liquid delivery element 40. The pressurizer 70 is arranged between an end (i.e., bottom) of the delivery tube 60 facing the chamber 49 and the liquid delivery element 40 such that it presses the liquid delivery element 40 toward the lower cap 30.

The pressurizer 70 may include a material having elasticity, such as rubber or silicon. As such, the pressurizer 70 may be arranged in a compressed state between the delivery tube 60 and the liquid delivery element 40 to thereby firmly press the liquid delivery element 40. Due to the pressurization action of the pressurizer 70 as described above, even if an operation of generating an aerosol by heating the liquid delivery element 40 is repeatedly performed, the liquid delivery element 40 may be stably maintained in the chamber 49 of the lower cap 30.

The pressurizer 70 includes a connection tube 71 that surrounds the bottom of the delivery tube 60 and connects the bottom of the delivery tube 60 to the chamber 49. The delivery tube 60 includes a flange formed at the end thereof, which protrudes from an outside of the delivery tube 60 to be caught by the connection tube 71 of the pressurizer 70.

The liquid storage 21 includes a support tube **22*b* that surrounds the other end (i.e., top) of the delivery tube 60 inside the liquid storage 21 and connects the bottom of the delivery tube 60 to the discharge hole 22*a*. Also, the liquid storage 21 includes a flange that protrudes from the outside of the delivery tube 60 at the top of the delivery tube 60 to be caught by the support tube 22*b* of the liquid storage 21. Therefore, the delivery tube 60 may be firmly supported between the chamber 49 and the discharge hole 22*a*** by the flanges respectively formed at both ends thereof.

The pressurizer 70 further includes a contact portion 72 and a material delivery hole **73*a*. The contact portion 72 that extends from an outside of the connection tube 71 toward the liquid delivery element 40 and directly contacts the liquid delivery element 40. The material delivery hole 73 that provides fluid communication between the liquid storage 21 and the liquid delivery element 40, such that the aerosol generating material accommodated in the liquid storage 21 is delivered to the liquid delivery element 40. The liquid delivery element 40 may be manufactured in an approximately cylindrical shape, and a bottom surface of the contact portion 72 contacting the liquid delivery element 40 may have a curved shape to correspond to a shape of an outer surface of the liquid delivery element 40**.

Terminals **21*t* for an electrical connection to a main body may be installed at a lower end of the liquid storage 21 of the cartridge 20 to be exposed to the outside. For example, the terminals 21*t* are installed at a lower end of the lower cap 30. For the electrical connection to the main body, the terminals 21*t* are installed to be exposed outside the lower cap 30. The terminals 21*t* deliver, to the heater 50, electricity supplied from the main body. The terminals 21*t* include coupling pipes 21*p* that pass through terminal passages 36 and protrude toward the chamber 49. The coupling pipes 21*p* are firmly coupled to the heater 50 (e.g., to the ends of a coil 50*a***).

Figure 7:
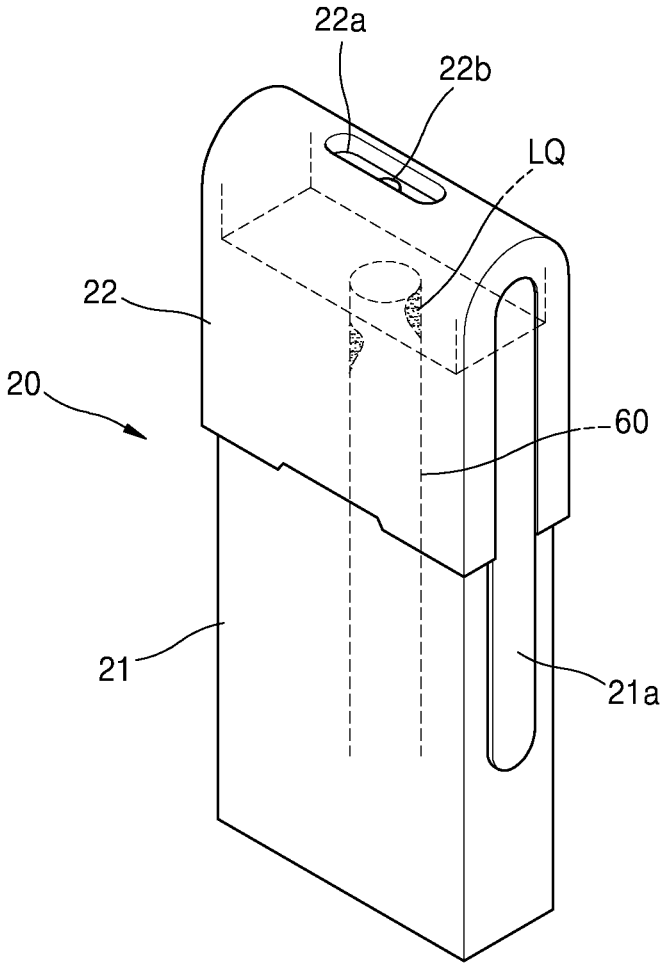
FIG. 7 is a perspective view schematically illustrating an example in which a liquid droplet is generated in the cartridge illustrated in FIG. 5.

FIG. 7 is a perspective view schematically illustrating an example in which a liquid droplet is generated in the cartridge illustrated in FIG. 5.

Referring to FIG. 7, an aerosol generated in a chamber may be cooled while being delivered to a discharge hole **22*a* through a delivery tube 60. Cooling of the aerosol may generate a liquid droplet LQ on a delivery path along which the aerosol is delivered (e.g., inside the delivery tube 60). When a user uses an aerosol generating device, the liquid droplet LQ generated inside the delivery tube 60** may be delivered directly into an oral cavity of the user by suction pressure of the user, which may cause displeasure to the user.

Figure 8:
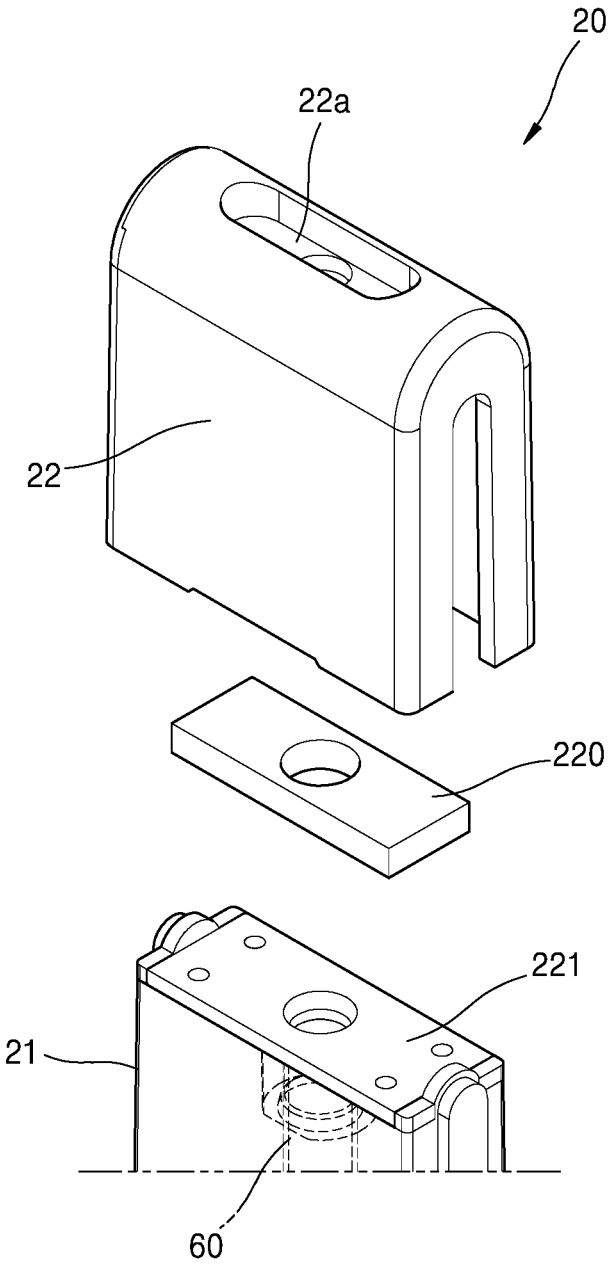
FIG. 8 is an exploded perspective view illustrating an embodiment of a discharge path of an aerosol in the cartridge illustrated in FIG. 5.

FIG. 8 is an exploded perspective view illustrating an embodiment of a discharge path of an aerosol in the cartridge illustrated in FIG. 5.

Referring to FIG. 8, to solve the drawback described with reference to FIG. 7, a cartridge 20 includes an absorbent element 220 capable of absorbing a liquid. The absorbent element 220 may be arranged on a delivery path along which an aerosol is delivered, between a delivery tube 60 and a discharge hole **22*a* of a mouthpiece 22. The absorbent element 220** may have a shape that does not interrupt the delivery path.

For example, in the embodiment illustrated in FIG. 8, the absorbent element 220 may have a cross-sectional shape corresponding to a cross-sectional shape of the cartridge 20 described above. The absorbent element 220 may include a through-hole through which an aerosol passes such that the aerosol flow is not interrupted by the absorbent element 220. In other words, two end portions of the absorbent element 220 which firsthand receives the aerosol generating material from the liquid storage 21 are connected to each other. As a result, even if a liquid is nonuniformly absorbed between the two portions of the absorbent element 220, the liquid may be absorbed by using the entire absorbent element 220 because the two portions of the absorbent element 220 are connected to each other.

The absorbent element 220 may be arranged on a placement portion 221 arranged at the top of the delivery tube 60. The absorbent element 220 may be stably fixed by coupling the mouthpiece 22 to the liquid storage 21 after the absorbent element 220 is placed on the placement portion 221.

The absorbent element 220 may be formed of a material capable of absorbing a liquid. For example, the absorbent element 220 may be formed of felt, sponge, cotton, or the like, but is not limited thereto.

Also, the absorbent element 220 may have a volume of about 50 $mm^3$ to about 120 $mm^3$ to sufficiently absorb a liquid that may be generated during smoking.

Figure 9:
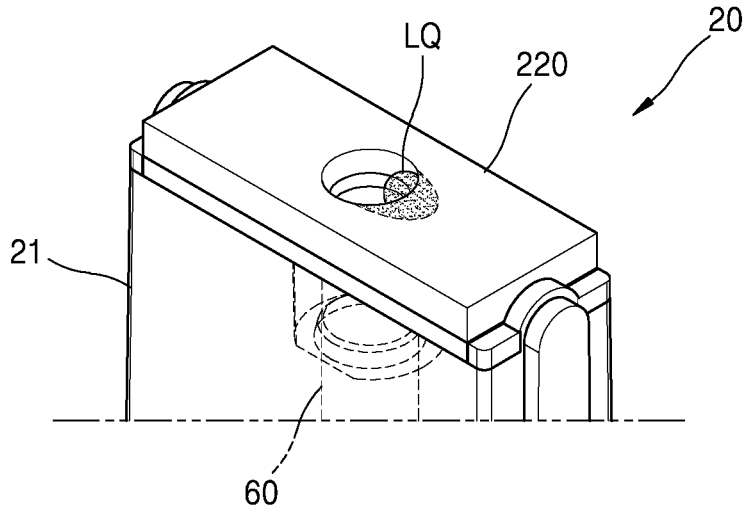
FIG. 9 illustrates an example in which a liquid droplet is absorbed in the embodiment illustrated in FIG. 8.
Figure 10:
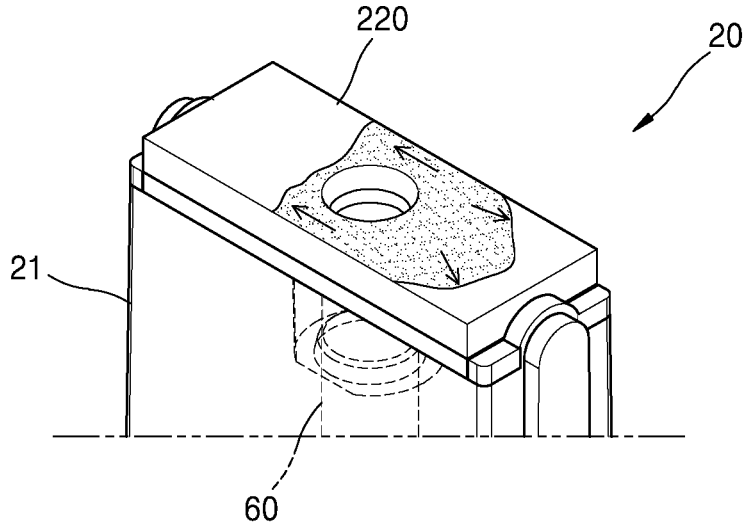
FIG. 10 illustrates an example in which the liquid droplet absorbed in the embodiment illustrated in FIG. 9 spreads throughout an absorbent element.

FIG. 9 illustrates an example in which a liquid droplet is absorbed in the embodiment illustrated in FIG. 8. FIG. 10 illustrates an example in which the liquid droplet absorbed in the embodiment illustrated in FIG. 9 is diffused in an absorbent element.

Referring to FIG. 9, a liquid droplet LQ may contact an absorbent element 220 when a liquid droplet LQ is generated on a delivery path of an aerosol or when the liquid droplet LQ generated elsewhere is moved by inhalation of a user. Since the absorbent element 220 is a material capable of absorbing a liquid, the liquid droplet LQ may be absorbed into the absorbent element 220, and thus it may be removed from the delivery path of the aerosol.

Referring to FIG. 10, after the liquid droplet LQ is fully absorbed into the absorbent element 220, the liquid droplet LQ may be diffused into the entire absorbent element 220. Therefore, even if the liquid droplet LQ is absorbed through a portion of the absorbent element 220, the liquid droplet LQ may be absorbed by the entire absorbent element 220. Therefore, a total volume of the absorbent element 220 may be utilized to absorb the liquid droplet LQ.

Figure 11:
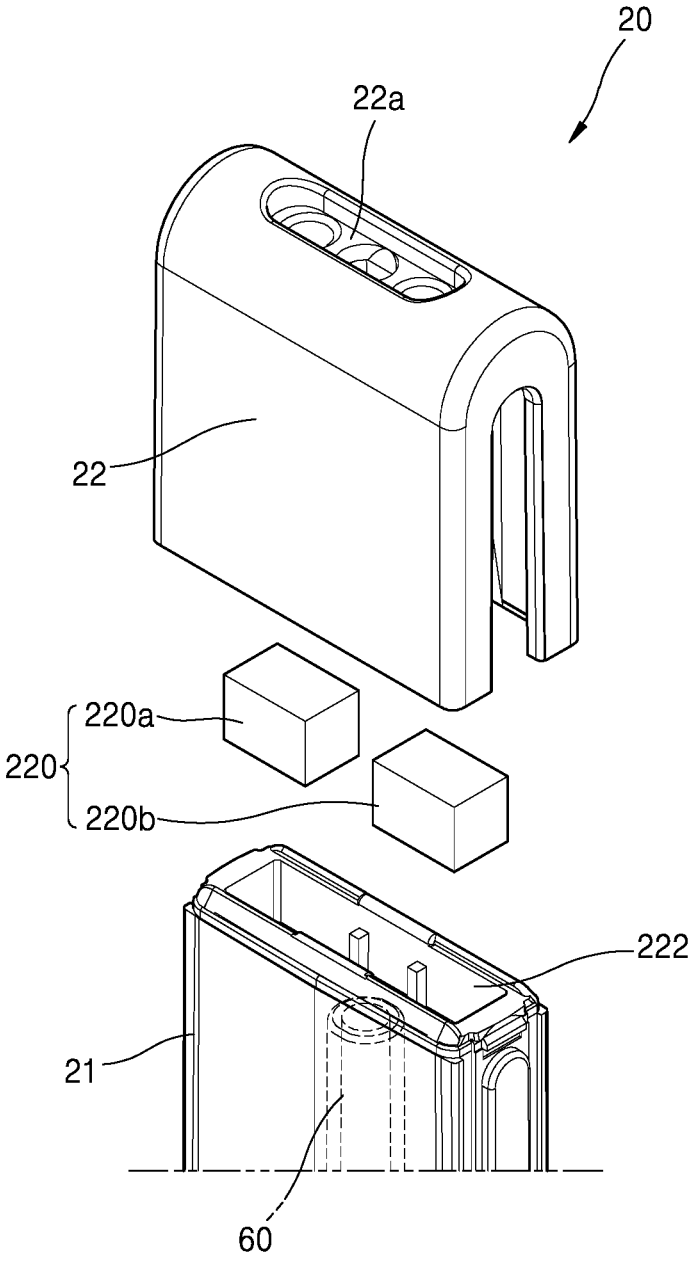
FIG. 11 is an exploded perspective view illustrating another embodiment of a discharge path of an aerosol in the cartridge in the illustrated in FIG. 5.

FIG. 11 is an exploded perspective view illustrating another embodiment of a discharge path of an aerosol in the cartridge illustrated in FIG. 5. Hereinafter, the detailed descriptions overlapping the above descriptions will be omitted.

Referring to FIG. 11, a cartridge 20 includes a plurality of absorbent elements 220 capable of absorbing a liquid. In the embodiment illustrated in FIG. 11, the plurality of absorbent elements 220 are illustrated as two absorbent elements 220*a* and 220*b*, but are not limited thereto. Thus, the number of the absorbent elements 220 may exceed two. For example, some absorbent elements 220*a* and 220*b* of the plurality of absorbent elements 220 are arranged apart from each other such that a delivery path of the aerosol is placed therebetween, as shown in FIG. 11. Other absorbent elements may be arranged to connect the absorbent elements 220*a* and 220*b*. Therefore, as in the embodiment illustrated in FIG. 11, even if a liquid is nonuniformly absorbed between the two absorbent elements 220*a* and 220*b*, the liquid may be absorbed by using the entire absorbent elements 220 since the two absorbent elements 220*a* and 220*b* are connected to each other.

The absorbent elements 220*a* and 220*b* are arranged in a placement space 222 arranged at the other end of a delivery tube 60. After the absorbent elements 220*a* and 220*b* are accommodated in the placement space 222, a mouthpiece 22 may be coupled to a liquid storage 21, thereby stably fixing the absorbent elements 220*a* and 220*b*.

Figure 12:
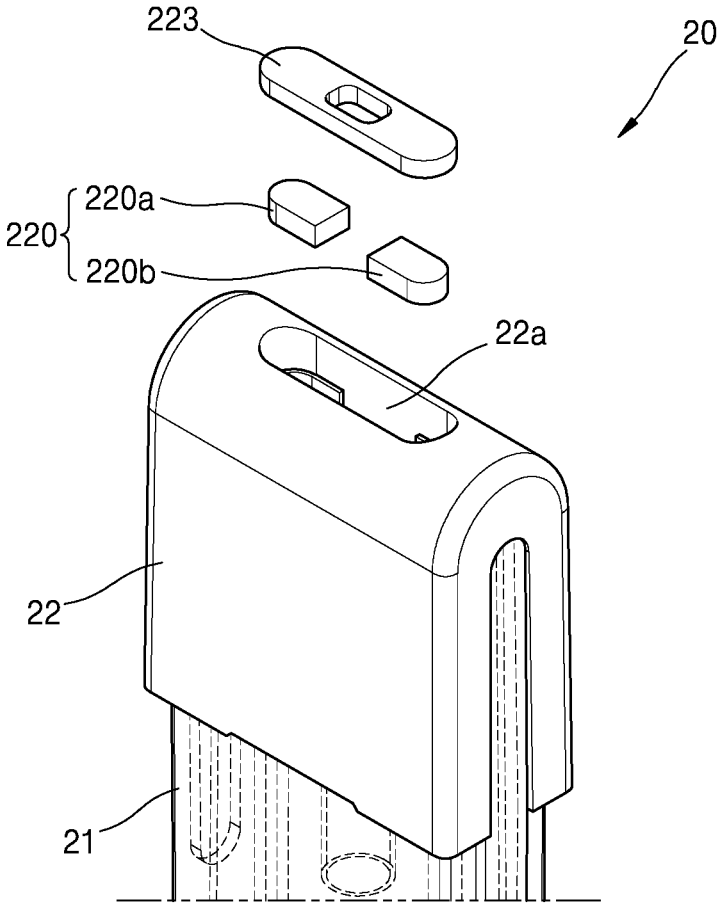
FIG. 12 is an exploded perspective view illustrating another embodiment of a discharge path of an aerosol in the cartridge illustrated in FIG. 5.

FIG. 12 is an exploded perspective view illustrating another embodiment of a discharge path of an aerosol in the cartridge illustrated in FIG. 5.

Referring to FIG. 12, a cartridge 20 includes a plurality of absorbent elements 220 capable of absorbing a liquid. In the embodiment illustrated in FIG. 12, the plurality of absorbent elements 220 are illustrated as two absorbent elements 220*a* and 220*b*, but are not limited thereto. Thus, the number of the absorbent elements 220 may exceed two. For example, some absorbent elements 220*a* and 220*b* of the plurality of absorbent elements 220 may be arranged apart from each other such that a delivery path of the aerosol is placed therebetween. Other absorbent elements may be arranged to connect the absorbent elements 220*a* and 220*b* spaced apart from each other.

The absorbent elements 220*a* and 220*b* may be arranged in a discharge hole 22*a* of a mouthpiece 22 through which an aerosol is discharged to the outside. In other words, the discharge hole 22*a* forms a placement space in which the absorbent elements 220*a* and 220*b* may be accommodated. To fix the absorbent elements 220*a* and 220*b*, a fixing element 223 may be fixedly coupled to the mouthpiece 22 in the discharge hole 22*a* after the absorbent elements 220*a* and 220*b* are accommodated in the discharge hole 22*a*. For example, the fixing element 223 may be fixedly coupled to the mouthpiece 22 by ultrasonic fusion, but is not limited to this fixedly coupling method. Therefore, the fixing element 223 may be fixed in the discharge hole 22*a* by various methods such as glue.

Although not illustrated in FIGS. 6 through 12, the cartridge 20 may further include a net that is arranged on the delivery path along which the aerosol is delivered, thereby preventing a movement of a liquid. When a user puffs an aerosol by using an aerosol generating device, a liquid may be filtered by the net, thereby preventing the liquid from being delivered to the user.

For convenience of description, FIGS. 6 through 12 illustrate three examples in which the absorbent element 220 is arranged in the cartridge 20, but the position where the absorbent element 220 is arranged is not limited thereto. Therefore, the absorbent element 220 may be located at other positions on a delivery path along which an aerosol is delivered to the outside, according to manufacture specifications of the cartridge 20.

At least one of the components, elements, modules or units (collectively "components" in this paragraph) represented by a block in the drawings such as the controller 460 and the user interface 440 in FIG. 4 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. A cartridge comprising:

a liquid storage configured to accommodate an aerosol generating material;

an atomizer configured to receive the aerosol generating material from the liquid storage to generate an aerosol;

a mouthpiece coupled to an end of the liquid storage and including a discharge hole through which the aerosol is discharged;

a delivery tube arranged inside the liquid storage and connecting the discharge hole of the mouthpiece with the atomizer such that the aerosol generated in the atomizer is delivered to the discharge hole; and an absorbent element arranged on a delivery path of the aerosol between the delivery tube and the discharge hole, and configured to absorb a liquid, wherein the discharge hole comprises a placement portion disposed at an end of the mouthpiece in a direction in which the aerosol is discharged to outside and configured to accommodate the absorbent element, and wherein the absorbent element is disposed on the placement portion.

2. The cartridge of claim 1, wherein the cartridge further includes a fixing element configured to fix the absorbent element in the discharge hole.

3. The cartridge of claim 1, wherein a cross section of the cartridge has a rectangular shape.

4. The cartridge of claim 1, wherein the absorbent element includes two absorbent element parts spaced apart from each other such that the delivery path is positioned between the two absorbent element parts.

5. The cartridge of claim 4, wherein the absorbent element includes at least one another absorbent element part arranged to connect the two absorbent element parts each other.

6. The cartridge of claim 1, wherein a volume of the absorbent element is between about 50 $mm^3$ and about 120 $mm^3$.

7. The cartridge of claim 1, further comprising a net arranged on the delivery path of the aerosol and configured to prevent movement of the liquid.

8. The cartridge of claim 1, wherein the absorbent element includes at least one of sponge, felt, and cotton.

9. The cartridge of claim 1, wherein the atomizer comprises:

a heater configured to heat the aerosol generating material;

a lower cap that surrounds the heater and encloses another end of the liquid storage, thereby forming a chamber in which the aerosol is generated; and a liquid delivery element arranged in the chamber of the lower cap and configured to absorb the aerosol generating material and generate the aerosol when heated by the heater, wherein an end of the delivery tube communicates with the chamber.

10. An aerosol generating device comprising:

the cartridge of claim 1;

a main body including an accommodation space that allows the cartridge to be detachably coupled to the main body; and a slider movably coupled to the main body such that at least a portion of the mouthpiece is covered and exposed according to movement of the slider.

* * * * *